US005555692A

United States Patent [19]

Griffith

[11] Patent Number: 5,555,692

[45] Date of Patent: Sep. 17, 1996

[54] LATTICE STRUCTURE FORMED FROM CURVED ELEMENTS

[76] Inventor: Henry S. Griffith, 2900 San Juan Rd., Aromas, Calif. 95004

[21] Appl. No.: 385,809

[22] Filed: Feb. 8, 1995

Related U.S. Application Data

[63] Continuation-in-part of Ser. No. 20,197, Mar. 21, 1994, Pat. No. Des. 360,531.

[51] Int. Cl.[6] ..... E04C 2/42

[52] U.S. Cl. ..... 52/662; 52/660; 52/656.8; 256/19; 256/24

[58] Field of Search ..... 52/660–663, 656.8, 52/107, 670; 256/5, 19, 21, 45, 37, 24

[56] References Cited

U.S. PATENT DOCUMENTS

| | | | |
|---|---|---|---|
| 135,837 | 2/1873 | Overholser | 256/21 X |
| 332,655 | 12/1885 | Hammill | 52/662 X |
| 651,590 | 6/1900 | Brightsan | 52/670 |
| 1,160,044 | 11/1915 | Coakley | 52/660 X |
| 1,556,063 | 10/1925 | Becker | 52/662 X |
| 1,591,328 | 7/1926 | Lachman | 52/656.8 X |
| 1,668,713 | 5/1928 | Forsyth | 52/660 X |
| 2,038,306 | 4/1936 | Miller | 52/656.8 X |
| 3,197,820 | 8/1965 | Claire, Sr. et al. | 52/660 X |
| 4,487,000 | 12/1984 | Ball | 52/664 X |

FOREIGN PATENT DOCUMENTS

| | | | |
|---|---|---|---|
| 0864206 | 12/1941 | France | 52/660 |

*Primary Examiner*—Carl D. Friedman
*Assistant Examiner*—Winnie Yip
*Attorney, Agent, or Firm*—Donald R. Boys

[57] ABSTRACT

A latticework structure providing a composite curved appearance is formed from slat elements each having a shape defined by a waveform curve repeating about a longitudinal axis, the waveform defined by a wavelength and a magnitude, each of the first slat elements having a substantially constant and common width orthogonal to the defining curve. Such elements are arranged in two levels with axes of symmetry of the slat elements all parallel, and the width of slat elements in one level at maxima points positioned to overlap the width of minima points of the slat elements on the other level, and the elements are joined at the areas of overlap. In a preferred embodiment, the elements are wooden slats, and in other embodiments other materials are used, such as plastic and metal. Joining methods are selected appropriate to the materials used. In an alternative embodiment elements on one level are parallel in one direction, and in the other level elements are parallel in a crossing direction to the direction of the axes of the first elements, providing a structure of increased strength exhibiting increased economy of manufacture. In both side-by-side and in crossing patterns, panels are provided with notches at the overlapping areas, producing panels with the thickness of a single slat element.

6 Claims, 7 Drawing Sheets

LATTICE STRUCTURE FORMED FROM CURVED ELEMENTS

CROSS REFERENCE TO RELATED DOCUMENTS

The present utility patent application is related to design patent application 29/020,197, filed Mar. 21, 1994, as a continuation-in-part, now U.S. Pat. No. Des. 350,531.

FIELD OF THE INVENTION

The present invention is in the area of lattice structures for various purposes, such as panels for fencing, arbors, and room separators.

BACKGROUND OF THE INVENTION

Lattice structures are very popular for many purposes where panels are typically useful, and generally combine desirable characteristics of strength, light weight, and low cost. FIG. 1, labeled prior art, shows a typical lattice structure 11 formed from straight elements such as elements 13 arranged in a crossing pattern and fastened together, forming openings 15 in the shape of parallelograms, often referred to as diamond-shaped.

The crossed lattice structure typically has border elements, such as elements 17, 19, 21, and 23, to make the overall structure stronger, and the define a boundary and elements for joining with other lattice structures to provide such as a fence or divider.

By varying structural dimensions and relationships in the assembly of a conventional lattice structure the relative area of openings may be varied, and the geometry of the parallelogram openings may be varied as well. For example, lattice structures of this conventional sort may have crossed horizontal and vertical elements (slats) fastened at right angles, in which case the openings are rectangles or squares. As is well known, and evident in FIG. 1, the structural elements form regular and repeatable openings by the fact that about one-half of the elements are arranged parallel at one angle with a fixed reference, and the other one-half are arranged parallel at a second angle with the same reference.

In the art up until the lime of the present invention, conventional lattice structures have been formed of straight elements, or slats, as shown in FIG. 1, and although these structures have many uses, the geometry is not pleasing to everyone, and the use of such structures is thus somewhat limited.

What is clearly needed is a lattice structure formed of other than straight elements, providing thereby a unique and more pleasing appearance, and openings of curved outline, which will provide structures adapted to expanded use.

SUMMARY OF THE INVENTION

In a preferred embodiment, as a new article of manufacture, a latticework structure is provided comprising a plurality of first slat elements each having a shape defined by a waveform curve repeating about a longitudinal axis, the waveform defined by a wavelength and a magnitude, each of the first slat elements having a substantially constant and common width orthogonal to the defining curve; and a plurality of second slat elements having the waveform shape and common width of the first slat elements; wherein the first slat elements are arranged in a first plane with the axes of symmetry parallel, the second slat elements are arranged in a second plane overlying the first plane also with the axes of symmetry parallel to one another and to the axes of symmetry of the first slat elements, and wherein the width of the second slat elements at maxima points overlaps the width of the first slat elements at minima points, the first and second slat elements joined at the areas of overlap.

In some important embodiments the slat elements are wooden and joined by such as gluing and stapling, and in others the material of manufacture is metal, plastic or glass. Single structures may be made with elements of different materials, such as alternating elements of wood and plastic. Several different methods of joining elements may be used, appropriate to the materials of the slat elements. In some embodiments borders made from straight slats may be used, the borders being joined to the lattice structure along one or more edges.

In an alternative embodiment, slat elements of curved definition are joined in a crossing pattern to provide a lattice structure of improved strength, providing also economies in manufacture. In other embodiments, the area of overlap of slat elements, whether produced as side-by-side patterns or in crossing patterns, may be notched to provide a secure fit of the elements to one another, and to provide latticework panels with the thickness of a single slat element.

The lattice structures of the present invention provide an alternative to conventional lattice structures, which are predominantly formed by crossing straight slats, providing a diamond pattern. The curved patterns produced in lattice structures of the present invention provide also increased alternatives for adjusting ratios of opening area to closed area for a lattice, and additional uses for lattices.

DESCRIPTION OF THE PREFERRED EMBODIMENTS

Figure 2A:
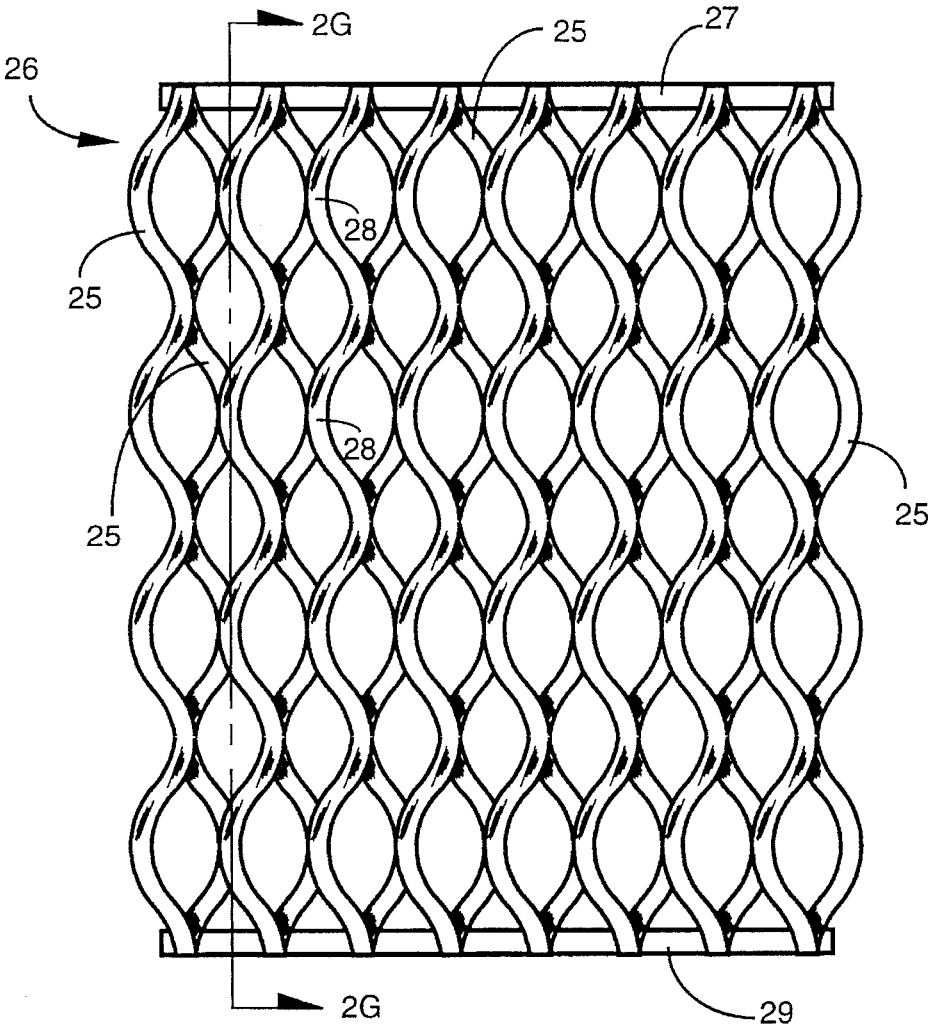
FIG. 2A is a plan view of a lattice structure according to the present invention.

FIG. 2A is a plan view of a lattice structure 26 according to an embodiment of the present invention, formed substantially of curved elements, such as elements 25. All of the elements 25 are not numbered in FIG. 2A, but all are similar in that the elements are not straight slats, but formed to have a repeating curved pattern. In a preferred embodiment the curved elements are made of a wood, such as redwood or cedar, of a uniform thickness, such as ¼ inch. It will be apparent to one with skill in the art that many other materials may be used, and thickness may vary as well over a broad range of dimensions. For example, in some embodiments, such as for room divider panels, molded plastic may be desirable, made in any of a variety of colors. Wooden embodiments may be more suitable for such as garden trellises, fences, and other outdoor uses.

Figure 1:
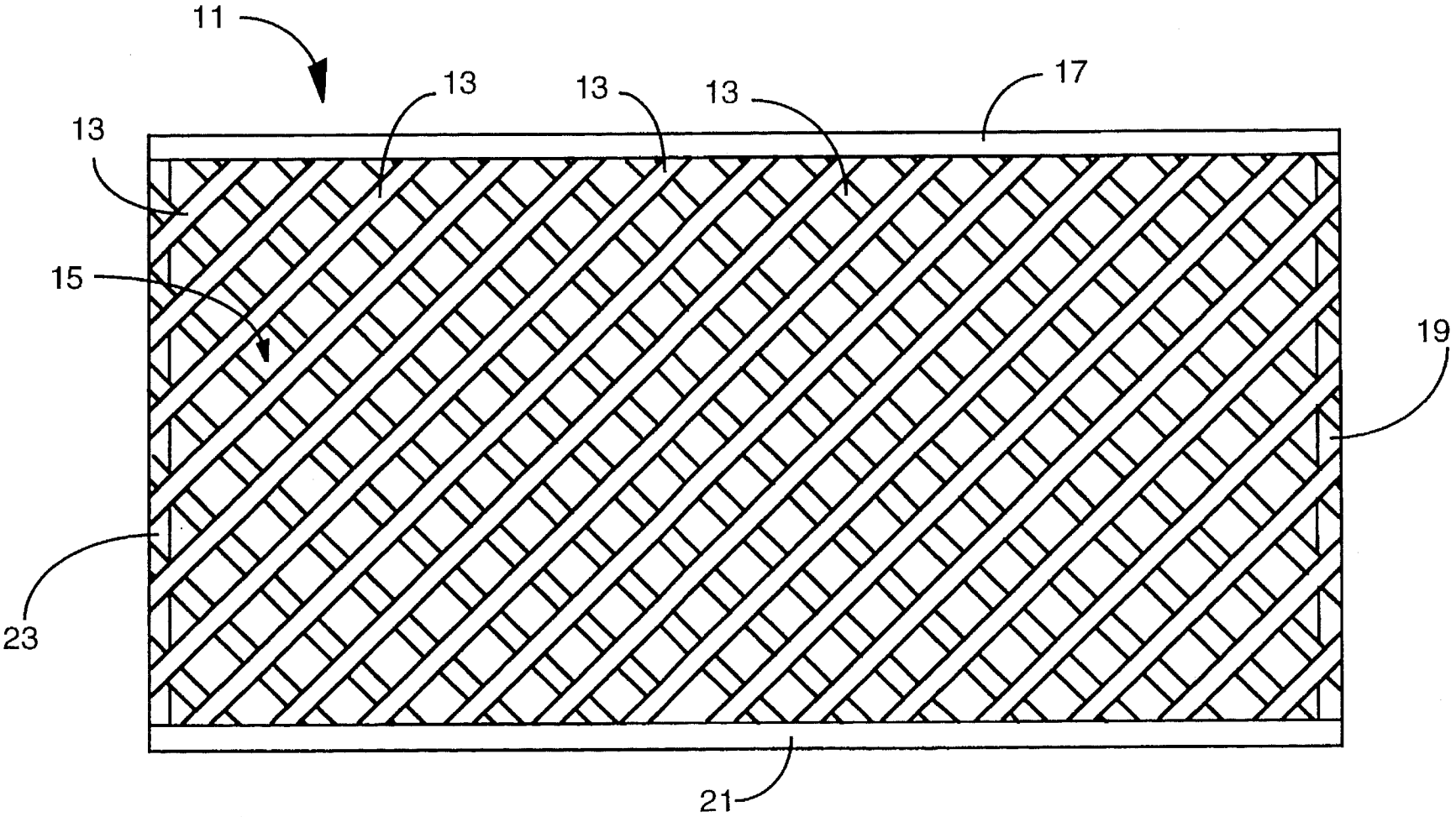
Fig. 1 PRIOR ART
FIG. 1 is a plan view of a portion of a prior art lattice structure.

Lattice structures made of curved elements, as in FIG. 2A, may also have borders of straight elements, such as elements 27 and 29. Although straight elements as borders may also be used on the ends of a curved lattice structure, similarly to elements 19 and 23 in FIG. 1, these are not needed or always desirable for structures to be further joined to make longer overall structures, such as fences and dividers.

Figure 2B:
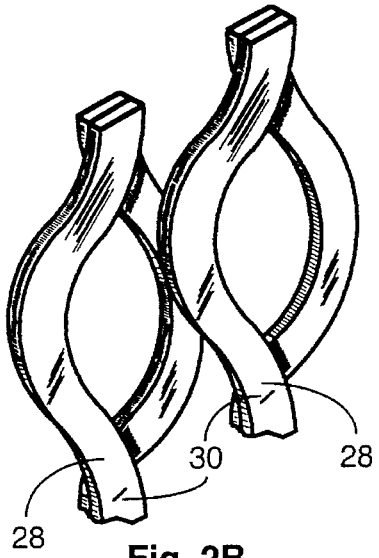
FIG. 2B is an isometric view of a portion of the lattice structure of FIG. 2A, to show the joining relationship between elements.

FIG. 2B is an isometric view of a portion of the lattice structure of FIG. 2A, to show the joining relationship of adjacent, overlapping elements. As is evident from the figure, the elements are substantially the same in geometry, but every second element in order is reversed in position, so overlapping areas are created where the elements are joined to form a lattice panel. Areas 28 in both FIGS. 2A and 2B are such overlapping areas, and staple fasteners 30 are shown in FIG. 2B.

Figure 2C:
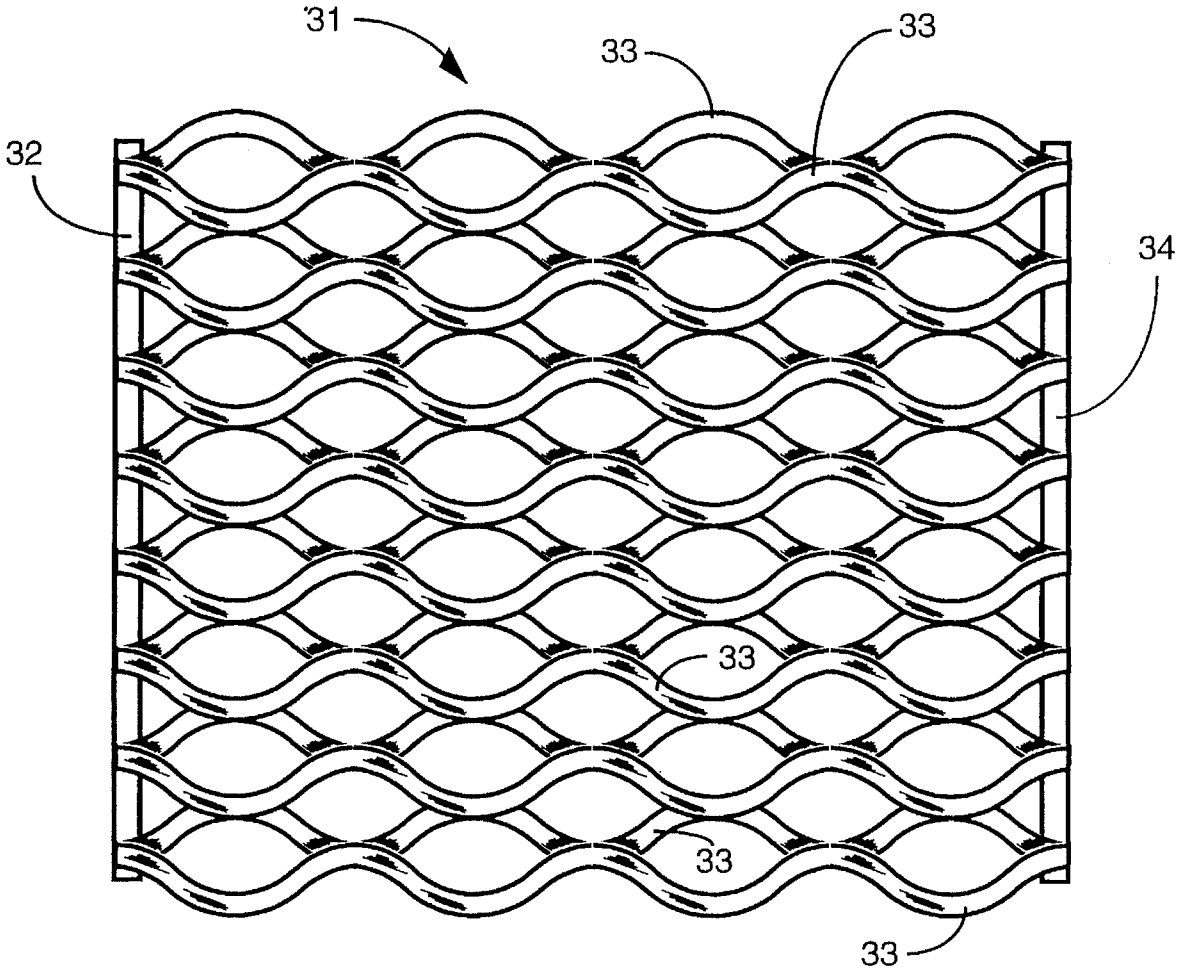
FIG. 2C is a plan view of an alternative lattice structure according to another embodiment of the present invention.

FIG. 2C is a plan view of an alternative arrangement of curved elements to form a lattice structure 31 according to an embodiment of the present invention. In the structure of FIG. 2C, curved elements 33 are oriented with their long axes horizontal, and border elements, such as elements 32 and 34, may be used at either end, at the top and bottom, or both.

Figure 2D:
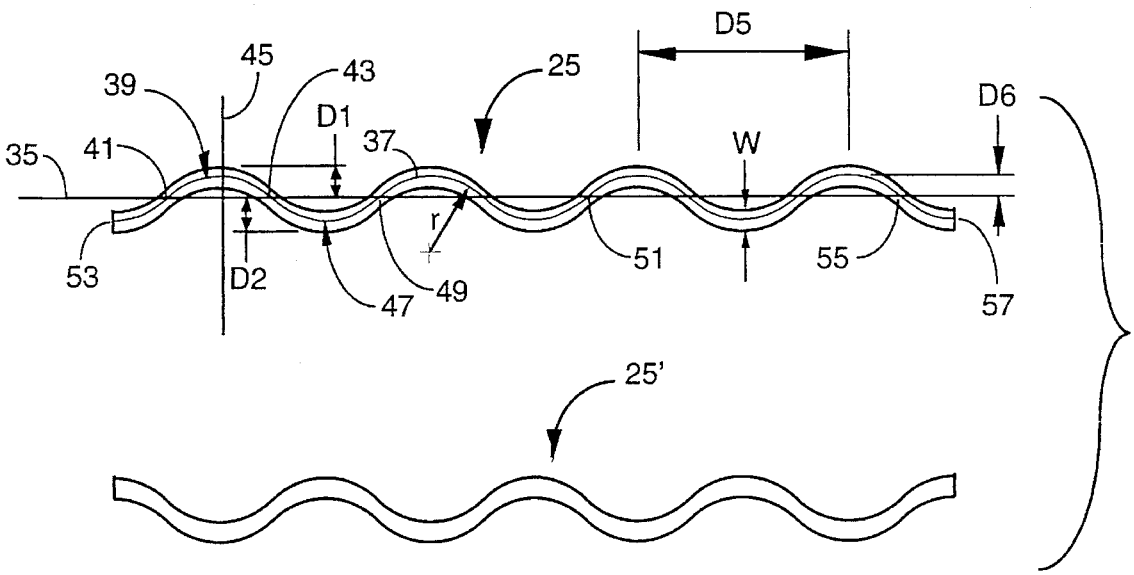
FIG. 2D is a plan view of two curved elements of the lattice structure of FIG. 2A or FIG. 2C.

FIG. 2D is a plan view of two elements 25 of lattice structure 26 of FIG. 2A. One of the elements is labeled 25' to distinguish it from the other element shown, although the elements are identical in geometry. These elements may also be two of elements 33 of lattice structure 31 of FIG. 2C, wherein the lower element is rotated 180 degrees about a longitudinal axis. As stated above, each element 25 or 33 is formed as a curved slat having a repeating geometry. The geometry can be arbitrarily described in a number of equivalent ways, using well-known mathematical and geometric terms. One such description follows.

Referring still to FIG. 2D, a longitudinal axis 35 is drawn for element 25, such that the deviation of the element to one side, given as D1, is equal to the deviation D2 to the other side. The element is thus symmetrical about axis 35. This symmetry is particular to this embodiment and some others, but not required in all embodiments of the invention. In some embodiments the deviation of curvature to one side may be greater than the deviation to the other side.

In the particular embodiment shown in FIG. 2D, the repeating curvature is defined by repeating, alternating circular arcs having a common radius r and defining a central line 37. Each full arc in the element defining a portion of central line 37 has an arcuate extent of ninety degrees. For example, arcuate portion 39 extending from point 41 to point 43 is a circular arc of radius r and ninety degrees extent. As points 41 and 43 both lie on longitudinal axis 35, half of the arc, or forty-five degrees, lies on each side of a bisecting line 45 perpendicular to longitudinal axis 35.

In a similar manner, arcuate portion 47, defining that portion of central line 37 from point 43 to point 49, is the mirror image of arcuate portion 39, and connects tangentially to arcuate portion 39 at point 43. Arcuate portions 39 and 47 together form a repeatable section of central line 37. That is, the section of central line 37 from point 49 to point 51 is identical to the section from point 41 to point 49. By repeating such arcuate portions alternating to each side of longitudinal axis 35 the full extent of central line 37 is formed except for end potions from point 41 to point 53, and from point 55 to point 57.

In FIG. 2D, curved element 25 has end portions of forty-five degree arcuate extent from point 41 to point 53 and from point 55 to point 57, and both end portions extend to the same side of longitudinal axis 35. Curved element 25 is defined on central line 37 by a width W centered on line 37 and measured along a line perpendicular to line 37. The thickness of element 25 (into the plane of the figure) is somewhat arbitrary, but is kept relatively small for economy. For example, for W=2 inches, the thickness may be about one-quarter inch. Element 25' is just like element 25, but rotated 180 degrees about the longitudinal axis.

Referring still to FIG. 2D, it is emphasized that the particular geometry described and illustrated above is exemplary, and in other embodiments, curvature is defined much differently. For example, in another embodiment the curvature follows a sinusoidal mathematical function. Slat elements having a sinusoidal (or cosinusoidal) curvature are preferred in some embodiments, because such elements may be readily made by cutting equipment known to the inventors wherein some cutting elements may be moved by one or more bell-crank mechanisms, forming such functional curvature. The essential requirement in this regard is that there be a repeating pattern deviating to either side for elements to be joined side-by-side.

Figure 2E:
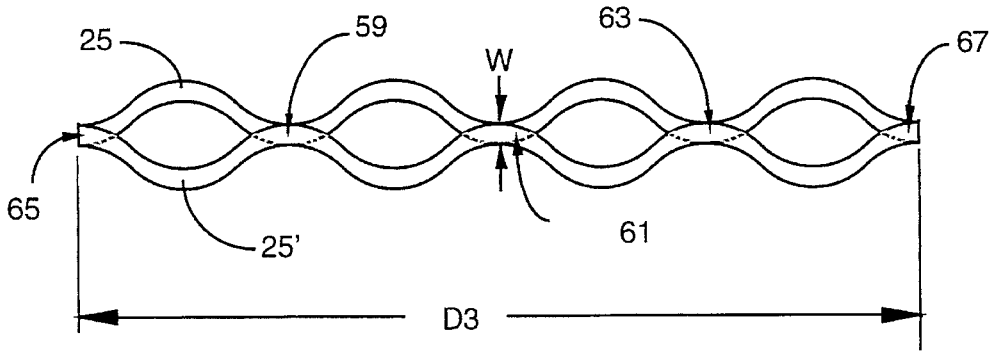
FIG. 2E is a plan view of the two curved elements shown in FIG. 2D, joined one to the other.

FIG. 2E is a plan view showing the two elements 25 and 25' of FIG. 2D positioned so that one overlaps the other across width W, and the two elements are joined at the areas of overlap. That is, element 25 is just as shown and as oriented in FIG. 2D, and element 25' is an identical element simply reversed (rotated 180 degrees around the longitudinal axis), and positioned so that the ends are congruent, which also causes the two elements to overlap at areas 59, 61, and 63, as well as at end areas 65 and 67.

As one step in forming a panel of elements, as shown in FIG. 2A or FIG. 2C, the two elements 25 and 25' are joined at the overlapping areas. There are several suitable methods of joining, and some methods may be preferable to others, depending on such things as the material of the elements and the intended use of a finished panel. For example, for wooden elements like redwood, stapling may be preferred in some instances, and gluing in others. In some instances gluing and stapling or nailing may be both used.

Figure 2F:
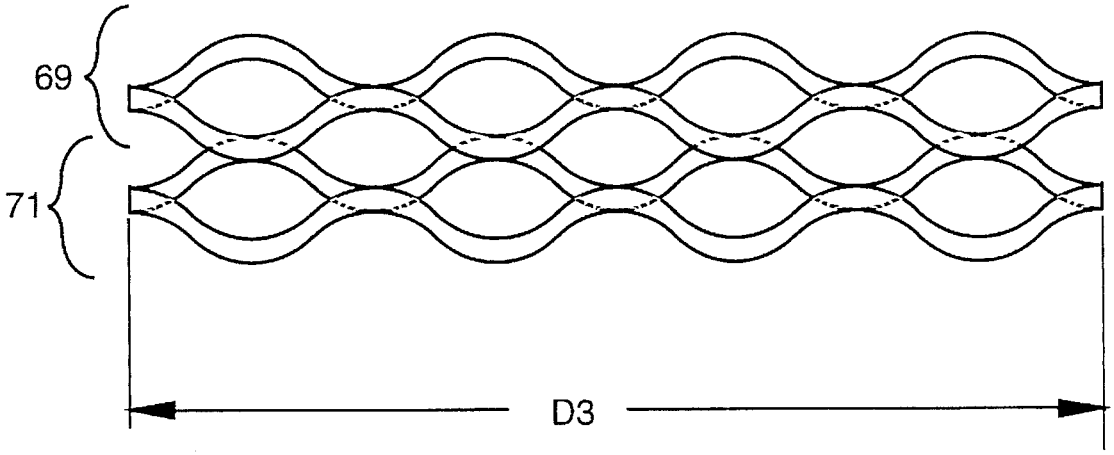
FIG. 2F is a plan view of a small panel formed of four joined elements in two sets.

FIG. 2F is a plan view of two joined element sets 69 and 71, each set identical to the joined set shown in FIG. 2E, with the two elements sets overlapped and joined to produce a small panel of four elements. By joining even more elements in the same manner a panel of arbitrary length may be formed. In practice, in a preferred embodiment, element longitudinal length D3 is about four feet, and the length for a panel constructed by joining elements as described above is about six feet. These dimensions, however, are exemplary only, and panels may be made in other embodiments of different dimensions. Panels of multiple elements joined in the manner shown in the figures and described above may be provided with borders of straight elements (slats) as shown in plan view in FIGS. 2A and 2C. Borders for strength of definition, and straight slats joined at other places to the curved element panels may also be provided.

Figure 2G:
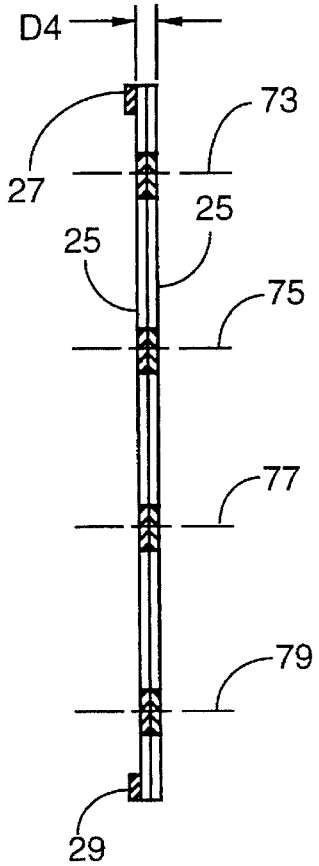
FIG. 2G is a section through the lattice structure of FIG. 2A along section line 2G—2G of FIG. 2A.

FIG. 2G is a section view of lattice structure 26 of FIG. 2A taken along section line 2G—2G of FIG. 2A. Two elements 25 are thus seen overlapped and joined, as described above, providing a panel of thickness D4, which is twice the thickness of an individual panel. So, if each slat element is one-quarter inch thick, D4 is one-half inch. If borders are used, as indicated for border slats 27 and 29, and the border slats are also one-quarter inch in thickness, the overall thickness is increased to three-quarters of an inch. Joining is at overlapping areas, at levels indicated by lines 73, 75, 77, and 79.

Figure 3:
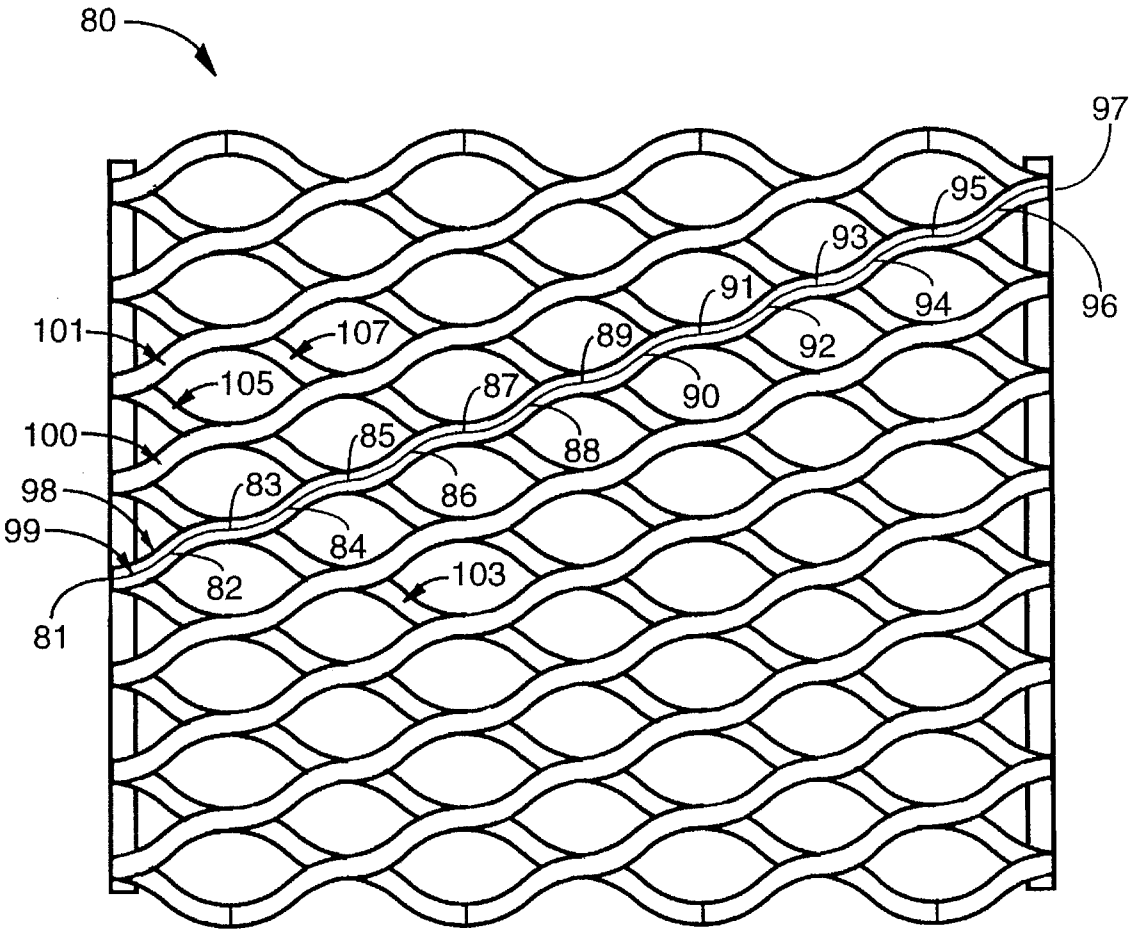
FIG. 3 is a plan view of a lattice structure according to an embodiment of the present invention having elements of an alternative shape.

FIG. 3 is a plan view of a curved lattice panel 80 according to an embodiment of the present invention, wherein each slat element has a distinctly different shape than the slat elements described above for panels 26 and 31. In this embodiment, curved slat elements are formed in a manner that they may be joined in a crossing pattern, very much as is done with conventional straight slats, instead of in a side-by-side arrangement, while still producing the curved openings and effect evident in the structures of FIGS. 2A and 2C, which are formed of side-by-side elements. As an example of the shape of such an element, refer to FIG. 3, beginning at point 81. A central line 99 of a single slat element 98 in this embodiment proceeds from point 81, along curved paths through points 82, 83, 84, 85, 86, 87, 88, 89, 90, 91, 92, 93, 94, 95, 96, and to point 97, where individual slat element 98 ends.

To form a lattice panel 80, curved slat elements such as elements 98, 100, and 101, are arranged substantially collinear, that is, in a parallel relationship, and overlying other similarly shaped elements such as elements 103, 105, and 107, and the overlying and underlying elements are joined at the overlapping areas by such as stapling, gluing, nailing, or a combination of these and other fastening methods.

A specific embodiment was described above, wherein the repeating curvature of a curved slat element was defined as comprising circular arcs of 90 degree extent and a particular radius, with alternate arcs reversed in the direction of concavity and joined to adjacent arcs tangentially. For slats to form an equivalent crossed-slat structure to the structure of the same overall geometry formed by side-by-side slats, the repeating curvature is defined by circular arcs of the same radius as for the side-by-side slats, but of ½ the arcuate extent (that is 45 degrees instead of 90 degrees), with each alternate arcuate portion reversed in direction of concavity and joined to the immediately adjacent arcuate portions tangentially.

As one further example, if the curvature of a side-by-side slat is sinusoidal, having a magnitude M1 and a wavelength WL1, with 0 degrees arbitrarily designated as the point the curve crosses the longitudinal axis rising, the curvature of the crossed slat to form the same pattern is a waveform comprising the portion of the first sine waveform from 0 degrees to 90 degrees, followed by the portion of the first sine waveform from 270 degrees to 360 degrees. The resulting waveform for the crossed pattern slat is related to the waveform of the side-by-side slat by a rather complicated formula, not reproduced here, but which may be produced by either of conventional mathematical or graphical methods.

It may be understood from the simple example given, referring to FIG. 3, that for any structure made of side-by-side elements as illustrated in FIGS. 2A and 2C, given a mathematical or geometric definition of the repeating curvature of the side-by-side slat elements, a corresponding definition of curvature may be defined for crossing elements, as seen in FIG. 3, to define the same pattern as seen for the panel composed of side-by-side elements. There is a very broad range of such definitions falling within the spirit and scope of the present invention, and the definitions that have been provided herein are exemplary only. Given one of the two waveforms, the other may always be derived, either by geometry of by graphical methods.

A particular advantage of a crossing pattern, as shown in FIG. 3, is increased strength for applications of lattice panels wherein such increased strength may be desirable or required, such as for lattice panels that will be expected to support plants (trellises) or manmade structures, as in some fencing requirements. Another advantage for the crossing elements to form a curved pattern per the present invention, is that the side-to-side deviation for cutting instruments to make the crossed element is much less than for the side-by-side elements that form the same assembled pattern, so there is savings in material when cutting slat elements from boards of a given size, and less power may be required to do the cutting.

Figure 4A:
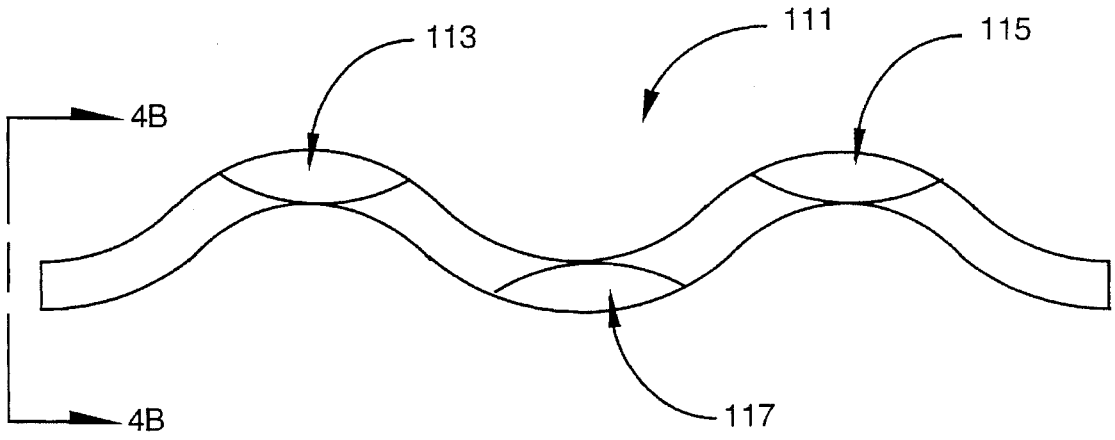
FIG. 4A is a plan view of a notched slat element.

In a further embodiment of the present invention, slat elements are notched at the joining areas such that all slat elements, when joined, lie in a common plane. FIG. 4A is a plan view of a slat element 111 of the type used for side-by-side assembly to make a latticework panel. As described above, the slat elements have a thickness consistent with the width and other considerations. In FIG. 4A, areas 113, 115, and 117 are the areas of overlap with other slat elements to make a latticework panel. By notching these areas to one-half of the thickness of the slat element, plural slat elements can be joined in a common plane making a latticework panel having just the thickness of a single slat element.

Figure 4B:
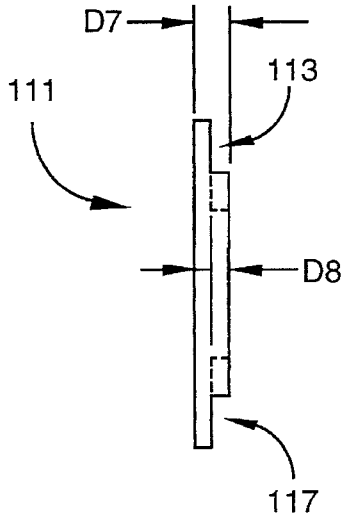
FIG. 4B is a side view of the notched slat element of FIG. 4A.

FIG. 4B is a side elevation view of slat element 111 of FIG. 4A as seen from the vantage of line 4B—4B of FIG. 4A. Notched areas 113, and 117 are seen clearly in this side view. The thickness of the slat element is D7 and the depth of each notch is D8, wherein D8 is one-half of D7.

In the slat elements formed to allow assembly in a crossing pattern, the areas of overlap may also be notched in the manner described by FIGS. 4A and 4B, so in a crossing pattern a latticework panel may also be formed with the thickness of a single slat element.

The inventor envisions a variety of processes that may be used to provide notches for slat elements as described immediately above, and some of these processes are not conventional for the purpose.

As has been described above, there are a very large number of variations in geometry that may be made while providing the curved effect of the lattice structures exemplified by FIGS. 2A and 2C, and others described herein. As there are many different patterns for the lattice structure formed from individual elements, and therefore many different definitions of individual side-by-side elements for forming the lattice structures, there are also an equivalent number of different definitions of crossing elements to provide the same pattern as side-by-side elements. Given the definition of a side-by-side element for forming a lattice structure, it is well within the purview of one with ordinary skill in the art to define and produce crossing elements to produce a panel with essentially the same pattern as provided by the side-by-side elements.

By altering dimensions and/or geometric definitions of individual elements for a curved-element lattice structure according to the present invention, a wide variety of effects may be produced. For example, one of the practical uses of such a lattice structure is to provide a divider or barrier, such as for a room divider, while at the same time allowing passage of considerable light through the structure, and even allowing a person to see through the structure to some extent. Ability to pass light and see through are both related to the relative ratio of opening to element area in a lattice structure.

Given a curved-element panel such as that shown in plan view in FIG. 2A, one can control the opening ratio by altering either the wavelength or the magnitude (or both) of the curve that defines the individual elements, whether the elements are side-by-side elements as in FIG. 2A, or crossing elements as in FIG. 3. To avoid misunderstanding for the purpose of this specification, wavelength and magnitude for an element are defined as follows: Refer to FIG. 2D, showing in plan view a single curved element having essentially a waveform pattern. The wavelength of the pattern is defined as the dimension in the direction of the axis of symmetry (line 35) from any one point on the curve (consider central line 37 as defining the curve), to a corresponding point where the curve begins again to repeat. That is, the length of a repeating portion of the curve. For example, in FIG. 2D, D5 is the wavelength. The magnitude is the deviation D6 of the curve to either side.

Patterns for various different effects and purposes may be created by altering the slat width, the curve wavelength, and the magnitude of deviation to either side of the longitudinal axis of the curve defining the shape of an individual element.

It will be apparent to those with skill in the art that there are a wide variety of alterations that may be made in the embodiments of the present invention described above without straying from the spirit and scope of the invention. For example, there are truly very many materials that might be used to make such curved-element panels, as mentioned above. Redwood is an advantageous choice for many such panels to be used out-of-doors, for such as garden arbors, fences, and patio dividers. Redwood is both colorful and durable. Other kinds of wood may be suitable and desirable for other applications, such as pine, cedar, and even hardwoods. Panels according to the present invention may be made from virtually any sort of wood.

For some applications, such as for office dividers and room dividers, and other indoor uses, plastic elements may be desirable. Such elements can be formed from a number of different plastic materials, such as polyvinyl chloride (PVC), polycarbonate, vinyl, and others. In some applications using plastic, it is envisioned that very small patterns may be suitable and desirable, having also a quite small element width and thickness, so that both wavelength and magnitude may be, for example, less than one inch. Materials are not limited to plastic and wood. Other materials, such as metals and glass may be used as well. In some embodiments, interesting effects can be created by using alternating elements of different kinds of wood, or different materials altogether, such as wood and plastic. One might create a panel according to the invention crossing metal elements with glass elements, for example.

Just as there is a broad variety of useful materials, there is also a broad variety of methods for joining elements, generally related to the materials used. For example, for those panels made of wooden elements, stapling at the overlapping areas is suitable, as is nailing. For metal elements one would use rivets, screws, or perhaps welding or brazing. For plastic elements adhesives may be suitable, and adhesives could also be used for joining wood and metal elements. Plastic elements can be joined in some cases by solvents (PVC), and in other cases by heat bonding, where the plastic has a low melting point.

Just as there is a broad variety of materials and a broad variety of joining techniques, there is a wide variety of forming, cutting, and shaping techniques that might be used. Curved wooden elements may be formed by gang saws moved in a carriage at right angles to a longitudinal direction of travel for a wooden block or blank to produce curved elements. The inventor has developed proprietary equipment for the purpose. Elements may also be formed by stamping and by cutting with gas time, water jets, and other apparatus and processes. Plastic elements may be extruded in curved forms, or extruded straight, then curved by a variety of processes, such as by heating and forming between longitudinal dies.

Overall sizes of panels made from such curved elements may also vary widely. Panels can be inches by inches, or several yards long and wide, and the intended use will govern in most instances. Many other variations might be described herein, but it will be apparent to those with skill in the art that there are many more variations than those described that fall within the spirit and scope of the present invention.

What is claimed is:

1. A panel structure comprising:

a plurality of planar structural elements, each structural element having a curved centerline shaped as a repeating wave of constant wavelength and maxima and minima points of equal magnitude about a longitudinal axis in each wavelength, each element also having a substantially constant width in the a plane of the element at a right angle to any tangent line to the curved centerline, and a substantially constant thickness at a right angle to the width, the width and thickness providing a substantially rectangular cross section having a width to thickness ratio of at least two to one;

wherein the structural elements are arranged in first and second planar layers with the longitudinal axes parallel and the elements in the second layer reversed maxima to minima from the elements in the first layer, and wherein the width of the elements of the first layer at-maxima points overlaps the width of the elements of the second layer at minima points, the width of the elements of the first layer at minima points overlaps the width of the elements of the second layer at maxima points, and wherein the elements of the two layers are joined at the areas of overlap.

2. A panel structure as in claim 1 wherein the structural elements are made of a material selected from the group of wood, metal, plastic, and glass.

3. A panel structure as in claim 1 wherein the structural elements are joined by one or more of processes selected from the group of nailing, stapling, gluing, welding, and heat sealing.

4. A panel structure as in claim 1 having four peripheral edges and further comprising at least one border element being a straight element of substantially constant width joined to the panel structure along one of the four edges.

5. A panel structure as in claim 4 comprising border elements joined to the panel structure along all four edges.

6. A panel structure as in claim 1 wherein the centerline wave shape is a sinusoidal wave.

* * * * *